US008096481B1

(12) United States Patent
Rudd

(10) Patent No.: US 8,096,481 B1
(45) **Date of Patent: *Jan. 17, 2012**

(54) VENTILATION SYSTEM CONTROL

(75) Inventor: Armin F. Rudd, Annville, PA (US)

(73) Assignee: ABT Systems, LLC, Anneville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/855,406

(22) Filed: Aug. 12, 2010

Related U.S. Application Data

(62) Division of application No. 11/142,093, filed on Jun. 1, 2005, now Pat. No. 7,798,418.

(51) Int. Cl.
*F24F 7/00* (2006.01)

(52) U.S. Cl. ..... 236/49.3; 454/256; 454/258

(58) Field of Classification Search ..... 236/49.3, 236/46 C; 62/157, 158, 231; 165/244, 270; 454/49, 239, 256, 258, 339, 341
See application file for complete search history.

(56) References Cited

U.S. PATENT DOCUMENTS 4,898,086 A 2/1990 Norris
5,547,017 A 8/1996 Rudd
5,579,993 A 12/1996 Ahmed
5,722,887 A 3/1998 Wolfson
5,881,806 A 3/1999 Rudd
5,971,067 A 10/1999 Rayburn
6,318,639 B1 11/2001 Toth
6,431,268 B1 8/2002 Rudd
7,222,494 B2 5/2007 Peterson
7,788,936 B2 * 9/2010 Peterson et al. ..... 62/158
2003/0127914 A1 7/2003 Homan

* cited by examiner

*Primary Examiner* — Marc Norman
(74) *Attorney, Agent, or Firm* — Brian S. Steinberger; Phyllis K. Wood; Law Offixes of Brian S. Steinberger, P.A.

(57) ABSTRACT

A method, system, apparatus, and device to provide an effective, automatic means to effect exhaust, supply, or balanced ventilation, or a combination thereof, by automatically activating a ventilation fan for the selected operation time per cycle interval based on prior fan operation due to automatic cycle operation and user demand. In a second embodiment the ventilation fan controller automatically activates said ventilation fan in conjunction with operation of a blower of a central air conditioning system. In a third embodiment, the ventilation fan controller also automatically operates the blower for the selected operation time per blower cycle interval, including operation due to thermostat and/or humidistat demand and operates the ventilation fan in conjunction with operation of the blower and/or for the minimal time selected per interval, including operation due to user demand. Optionally, a position of an outside air intake damper is controlled in conjunction with activation of the blower.

8 Claims, 9 Drawing Sheets

VENTILATION SYSTEM CONTROL

This application is a divisional application of U.S. application Ser. No. 11/142,093 filed on Jun. 1, 2005 now U.S. Pat. No. 7,798,418, now allowed.

FIELD OF THE INVENTION

This invention relates to distributing air in an interior space, and, in particular, to methods, systems, apparatus and devices to control operation of a ventilation fan, such as a bathroom, laundry, or vented range hood exhaust ventilation fan, a heat or energy recovery ventilation fan, and a supply ventilation fan, and/or an air distribution fan of a central air conditioning system dependent on prior operation of at least one of the ventilation fan and the air distribution fan, in order to exhaust polluted indoor air and distribute fresh outdoor air, and optionally, operates an outside air damper in an outside air duct of the air conditioning system in conjunction with and/or dependent on prior operation of the air distribution fan.

BACKGROUND AND PRIOR ART

Because of the effects indoor air has on health, comfort and durability, indoor air quality in our homes is becoming of increasing concern to many people. The Environmental Protection Agency lists poor indoor air quality as the fourth largest environmental threat in our country. Asthma is leading serious chronic illness of children in the U.S. and moisture-related construction defects and damage are on the increase in new houses. Minimum residential ventilation can improve many of these indoor air quality problems.

The most current standard describing residential ventilation practice for acceptable indoor air quality is Standard 62.2-2004, published by the Association of Heating, Refrigeration, and Air-conditioning Engineers in Atlanta, Ga. As a standard for use in regulation, 62.2 describes the minimum requirements for mechanical and natural ventilation systems that are necessary to provide minimally acceptable indoor air quality for typical situations. Standard 62.2 is applicable to both new and existing homes, including all single-family homes and small multi-family ones.

Local ventilation, such as vented range hoods and bathroom and laundry exhaust fans, is intended to exhaust pollutants from specific rooms in which sources are expected to be produced before they enter the general environment. Whole house ventilation, such as integrated with central air conditioning systems, is intended to bring fresh air into the general environment to dilute pollutants that cannot be effectively controlled at the source.

In central air conditioning systems, the conditioned air is distributed by the air distribution fan or blower, through various ducts throughout an indoor space in order to place the conditioned air at desirable locations. Generally, a thermostat and/or humidistat are used to activate the central air conditioning system. For example, when the indoor air temperature drops below a selected level, the air temperature sensor and switch in the thermostat can activate the heating apparatus and the air distribution fan. Likewise for indoor air temperatures above a selected level, and air humidity above or below corresponding selected levels, the thermostat and/or humidistat activate a cooling apparatus, dehumidifier or humidifier, respectively, and the air distribution fan.

Unlike central air conditioning systems, indoor local ventilation systems are usually manually operated by the user. Residential ventilation systems can be exhaust, supply, or balanced in terms of the air pressure effect on the interior of the building with respect to the outdoors. These systems can be multi-point or single-point, meaning that the air can be exhausted from or supplied to many points or a single point. Single point ventilation systems, typically exhaust fans, are not integrated with the operation of the central air conditioning system and have poor distribution of ventilation air. When activated, the exhaust fan exhausts indoor air for the time period that the exhaust fan is activated. However, the exhaust fan may not be activated as often as required and when activated, the time period for the activation may not be adequate. For example, the range hood fan is not usually activated when the kitchen is used to prepare food unless the preparation generates offensive odors or strong pollutants such as smoke, prompting the user to activate the overhead fan. When preparing food without activation of the overhead fan, the pollutants produced are not exhausted and therefore they enter the general environment.

A known prior art control systems for periodically operating the air distribution fan of the central air distribution system are disclosed in U.S. Pat. Nos. 5,547,017, 5,881,806 and 6,431,268 issued to Armin Rudd on Aug. 20, 1996, Mar. 16, 1999 and Aug. 13, 2002, respectively, the same inventor as the present invention and which are hereby incorporated by reference thereto. The air distribution cycling control systems periodically operate the air distribution fan for a first selectable time period after a second selectable time period from the end of the last operation of the air distribution fan. Simply put, it operates the air distribution fan dependent on prior operation of the fan. However, no known control systems exist for controlling the periodic operation of both a household ventilation fan and the air distribution fan, depending on prior operation, for ventilation and air mixing.

Prior art related to the air distribution and ventilation cycling portion of the present invention are cited but were not found to overcome the problems cited above. See for example, U.S. Pat. No. 4,898,086 to Norris wherein a photoelectric device in conjunction with a relay actuates a fan to ventilate the house for a period of time determined by a time delay device. The photoelectric device detects a change in outdoor lighting, such as sunrise, to activate the fan.

U.S. Pat. No. 5,772,887 to Wolfson et al. describes an automatic program ventilation control system that allows a user to programmably select a duty cycle, a time of day and a fan speed to automatically operate a fan for a specified length of time within a specific time interval. The programmable system also includes a manual override for manually activating the fan at a selected speed for a selected time. However, the system fails to provide alternative selectable modes of operation of the fan such as continuous operation and manual operation only, and fails to base the interval on prior operation of the ventilation fan due to automatic cycle operation and manual activation. The Wolfson et al. system also fails to provide optional modes for activation of the fan in conjunction with operation of a blower of a central air conditioning system.

U.S. Pat. No. 5,971,067 issued to Rayburn, et al., provides an air quality system that requires a sensor for sensing the quality of the indoor air and drawing in additional outdoor air when a problem is detected U.S. Pat. Appl. Pub. No. 20030127914 to Homan, Timothy C. et al., discloses a system that activates the exhaust fan when the light is switched on and causes the fan to continue operation for a time period after the light is switched off.

U.S. Pat. No. 6,318,639 issued to Toth describes a thermostat with temporary fan on function for selecting a predetermined time for enabling operation of the air circulating fan and a period of time for the operation.

Also see U.S. Pat. No. 6,695,218 issued to Fleckensein which provides a system that monitors air conditioning operation and performs calculations to determine when the building circulation fan would improve the comfort level.

The prior art fails to automatically activate an existing ventilation fan based on prior operation of the ventilation system and/or in conjunction with the operation of the central air distribution system. The present invention provides a means for a user to select a ventilation fan operational mode and optionally includes operation in conjunction with the operation of the air distribution fan.

In a first embodiment, the system is selectably set for continuous operation, manual operation, or operation of the ventilation fan for the minimal time selected per cycle interval, including operation due to manual user demand. In a second embodiment, the controller provides an effective, automatic means to effect exhaust, supply, or balanced ventilation, or a combination thereof, in conjunction with operation of the central air conditioning system for improved distribution of ventilation air. In a third embodiment, the cycling system includes a means for making sure that the central air distribution fan is ON, for a minimum selected or determined time per interval, including operation due to demand from, at least one of, a thermostat, humidistat, and dehumidistat Optionally, the outside air damper would be cycled off (closed) independent of the air distribution fan if the minimum selected or determined ventilation time was accomplished.

SUMMARY OF THE INVENTION

A primary objective of the present invention is to provide a new apparatus, method, system and device to exhaust and dilute polluted indoor air and increase the distribution of fresh outdoor air within an interior space.

A second objective of the invention is to provide a new method, system, apparatus and device for automatically controlling operation of a new or existing ventilation fan, having a duct to the outside, and/or operation of the central air conditioning system blower, having ducts to distribute air within the space, and optionally having an outside air duct and optional motorized damper. Use of existing fans and ducts is effective and less expensive than fans and ducts specially installed for additional ventilation.

A third objective of the present invention is to provide a new apparatus, method, system and device to allow automatic operation of a ventilation fan for a selected or determined time per cycle interval based on prior operation of the ventilation fan due to automatic cycling operation and manual user demand.

A fourth objective of the invention is to provide a new apparatus, method, system and device for selectively controlling the operation a ventilation system periodically for a selected or determined time in conjunction with the operation of an air distribution blower of a central air conditioning system based on prior operation of the central air conditioning system blower and the ventilation fan.

A fifth objective of the invention is to provide a new apparatus, method, system and device for automatic cycling operation of the central air conditioning system blower for a selected or determined time per cycle interval and selectively automatically activating the ventilation fan based on operation status of the blower.

A sixth objective of the present invention is to provide an apparatus, system and method for selecting time-of-day, and day-of-week for use in conjunction with the automatic cycling operation.

A seventh objective of the present invention provides an apparatus, system and method for selecting a mode of central air conditioning system operation for activation and deactivation of the automatic cycling operation.

In a first preferred embodiment of the invention, the controller is selectively set or programmed for one of a continuous operation, manual operation, or for automatic cycling operation of the ventilation fan for the minimal selected or programmed time per cycle interval including operation due to user demand.

For the second embodiment, the controller provides an effective, automatic means to effect exhaust, supply, or balanced ventilation, or a combination thereof, in conjunction with or dependent upon operation of the central air conditioning system for improved distribution of ventilation air.

For the third embodiment, the novel controller automatically operates the central air conditioning system air distribution fan for a minimum selected or programmed time per interval, including operation due to thermostat and/or humidistat and/or dehumidistat demand and operates the ventilation fan in conjunction with operation status of the blower and/or for the minimal time selected per interval including operation due to user demand. Optionally, the controller automatically cycles operation of the blower for a selected or programmed time per cycle interval based on prior operation of the blower. Optionally, a position of a damper is controlled in conjunction with or dependent on operation status of the blower.

For the fourth embodiment of the invention, the controller excludes automatic activation of the ventilation fan and/or the central air conditioning system blower based on at least one of: a selected or programmed time of day; a selected or programmed day of week; and the heating, cooling, dehumidification, or humidification mode of the central air conditioning system as monitored by the ventilation fan controller.

Further objects and advantages of this invention will be apparent from the following detailed description of preferred embodiments which are illustrated schematically in the accompanying drawings.

DESCRIPTION OF THE PREFERRED EMBODIMENTS

Figure 1:
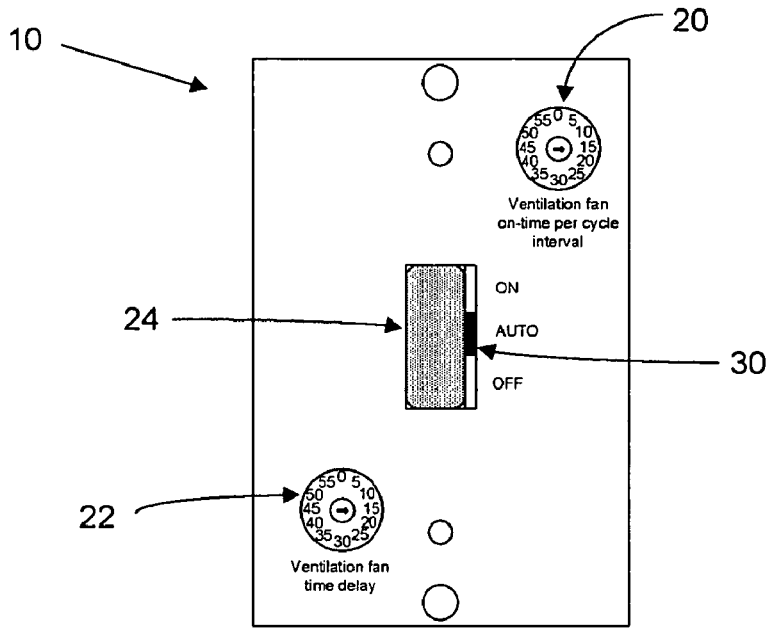
FIG. 1 is a front view of a first embodiment of the fan cycling controller of the present invention.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

The following is a list of the reference numbers used in the drawings and the detailed specification to identify components:

| | |
|---|---|
| 10 | Fan cycling controller - first embodiment |
| 14 | Cover plate |
| 16 | Enclosure |
| 18 | Electrical interface |
| 20 | Ventilation fan on-time selector |
| 22 | Ventilation fan time delay selector |
| 24 | Ventilation fan manual activation switch |
| 30 | Ventilation fan operational mode selector |
| 35 | Ventilation fan auto mode selector |
| 50 | Fan cycling controller - second embodiment |
| 60 | Fan cycling controller - third embodiment |
| 65 | Blower on-time selector |
| 70 | Electrical interface |
| 72 | Terminal block - central system controller |
| 74 | Terminal block - fan cycling controller |
| 76 | Terminal block - central air conditioning system |
| 110 | Fan cycling controller |
| 120 | Ventilation fan |
| 122 | Air filter |
| 124 | Cooling and dehumidifying apparatus |
| 126 | Heating and humidifying apparatus |
| 128 | Air supply duct |
| 130 | Central air conditioning system |
| 132 | Blower |
| 134 | Damper |
| 136 | Air return duct |
| 138 | Outside air duct |
| 140 | Central air conditioning system controller |

The method, system, apparatus and device of the present invention allows the user to select an operational mode for activation of a ventilation system for ventilating the area covered by the ventilation system. Residential ventilation systems include exhaust, supply or balanced ventilation in terms of the air pressure effect on the indoor area with respect to the outdoors. These ventilation systems are either single-point or multi-point. A single point-ventilation system exhausts or supplies air to a single point, or area, while a multi-point ventilation system exhausts or supplies air to multiple points. Multi-point ventilation systems have better air distribution than single-point system, however, multi-point systems are often avoided because of the higher cost of ductwork. Single point ventilation systems that do not employ periodic whole-house mixing operation of the multi-point supply central air conditioning system therefore interact more locally and have poor distribution of the ventilation air.

For example, the single point ventilation system may be an exhaust fan located in a bathroom. Typically, the exhaust fan is manually activated by the user flipping a switch. When activated, the exhaust fan exhausts air from the room until the user deactivates the exhaust fan. Another type of system combines activation of the exhaust fan with activation of the light in the room. A user enters the room, turns the light switch ON and the light and the exhaust fan are activated. In both examples, the room is only ventilated when activated by the user and is activated until the user turns the ventilation fan off. Since the ventilation fan is not operated continuously or operated periodically to ventilate the space, the ventilation rate may be inadequate. Furthermore, the single point ventilation system has poor distribution of ventilation air because the air distribution is localized rather than interacting with the whole house.

First Embodiment

In a first embodiment of the invention the fan cycle controller activates the ventilation fan for a minimum selected on-time per cycle interval. Operation of the ventilation fan in this embodiment is based on prior operation of the ventilation fan due to automatic cycle operation and user demand. The fan cycling controller 10 includes a manual activation switch 24, selectable on-time per cycle interval 20, a selectable time delay 22, and a selectable ventilation mode 30 as shown in FIG. 1. While FIG. 1 illustrates a controller having switches, the switches are provided for illustrative purposes and not for limitation. Those skilled in the art will recognize that alternative configurations, such as a programmable selector having a display and keys for selecting various operations or a processor controlled computer program, may be substituted without deviating from the scope of the invention.

The interval selector 20 allows the user to select the minimum length of time the ventilation fan is operated per cycle interval, including operation due to user demand. For example, the user may select 20 minutes of operation per cycle interval. If during the cucle interval there was 10 minutes of manually activated operation, then the ventilation fan controller would activate the ventilation fan the balance of 10 minutes of operation within the cycle interval. For manual activation by the user (on demand), manual activation push-button 24 and time delay selector 22 are provided. The user selects a time delay and each time the manual activation 24 is depressed, the fan cycle controller activates the ventilation fan for the selected delay time. If 'zero' is selected on time delay selector 22, manual activation of push-button 24 causes conventional ON/OFF control whereby each successive activation reverses the previous state of the ventilation fan operation.

There are three modes of ventilation fan operation, ON, OFF and AUTO. In the ON mode, the ventilation fan is operated continuously. In the OFF mode, the ventilation fan is deactivated unless manually activated by the user. The third mode of operation is AUTO, which causes the ventilation fan to automatically operate for a selectable on-time per cycle interval based on prior operation due to the automatic cycling and manual activation. If 'zero' is selected for the minimum ventilation fan on-time, automatic activation of the fan is disabled.

Figure 2A:
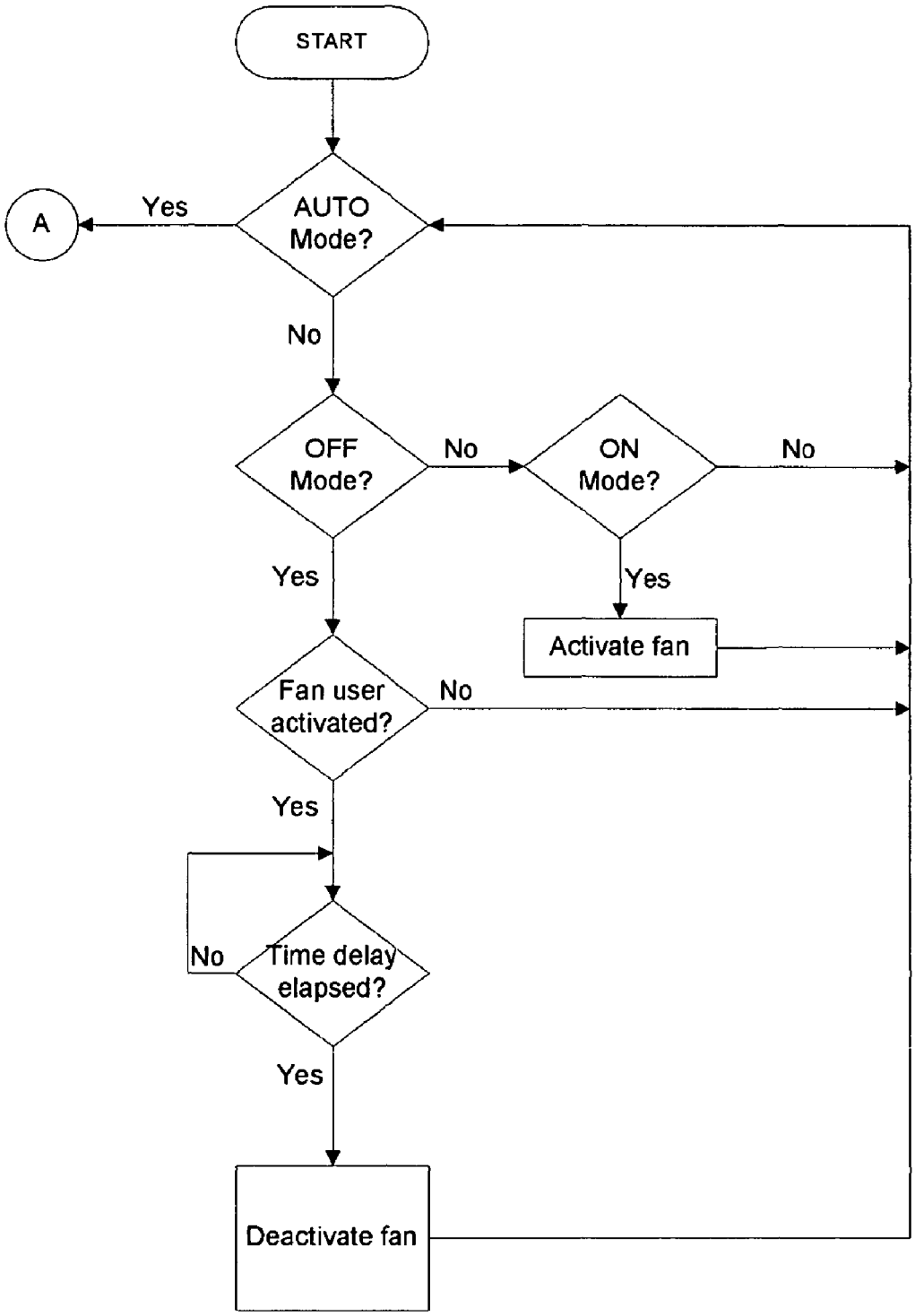
FIGS. 2*a* and 2*b* are flow diagrams of the operation of the fan cycling controller according to the first embodiment of the invention.
Figure 2B:
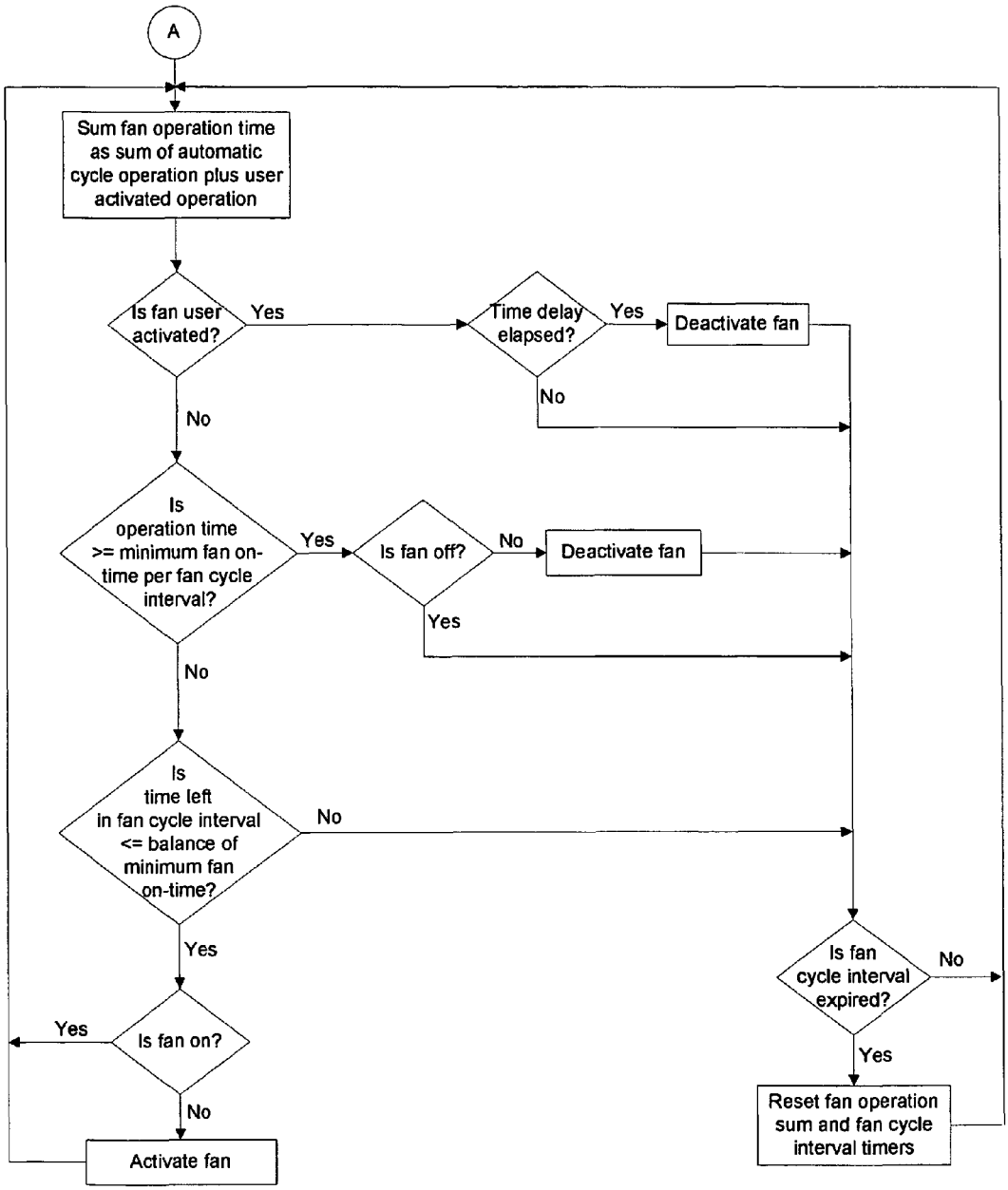

FIGS. 2*a* and 2*b* are flow diagrams of the operation of the fan cycle controller according to the first embodiment. In FIG. 2*a*, operationally, the fan cycle controller 10 monitors the selectable operational mode and the ventilation fan operation. When the ON mode of operation is selected, the controller activates the ventilation fan. When the OFF mode of operation is selected, the ventilation fan remains off unless manually activated 24. If the OFF mode is selected and the ventilation fan is manually activated, the ventilation fan remains activated until the optional delay time has elapsed.

FIG. 2*b* is a flow diagram of operation of the fan cycle controller in the auto mode according to the first embodiment shown in FIG. 1. The fan cycle controller 10 monitors the prior operation of the ventilation fan due to automatic cycling and manual user activation. When the fan is user activated, the fan will operate until the optional time delay expires. If the fan cycle interval expires during manual operation, the monitored operation time and fan cycle interval timers are reset. If the ventilation fan is not user activated and automatic activation is required to meet the minimum fan on-time per selected fan cycle interval, the fan is activated accordingly.

As shown in FIG. 2*b*, the fan cycle controller monitors and tracks the ventilation fan operation time. If the interval has elapsed and the sum of the operation time due to user demand and automatic cycling is less than the selected fan on time per interval, the ventilation fan is activated for the remaining balance of selected on time. When the fan on time or balance of fan on time, expires, the ventilation fan is deactivated and the fan operation sum and fan cycle interval timers are reset for a next cycle interval. When the cycle time interval has not elapsed, the fan cycle controller continuously monitors the status of the manual activation switch.

Second Embodiment

Figure 3:
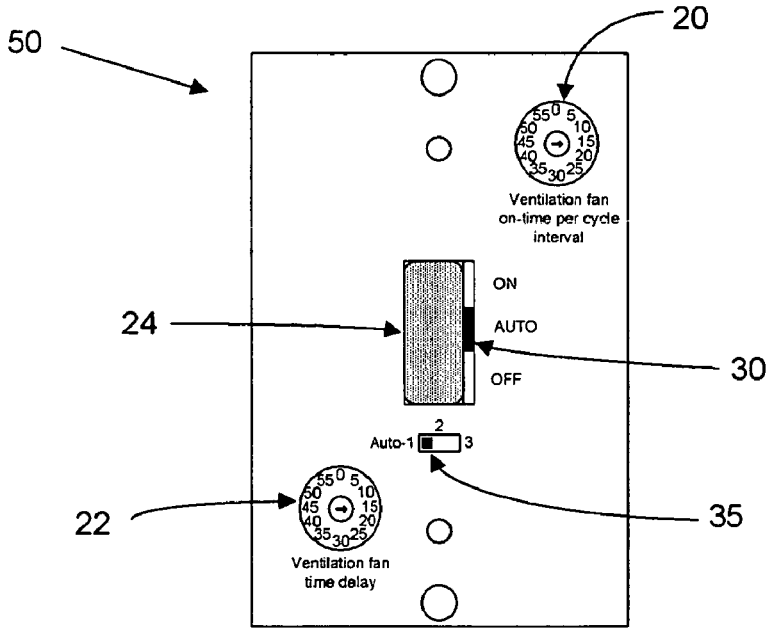
FIG. 3 is a front view of a second embodiment of the fan cycle controller of the present invention.
Figure 4:
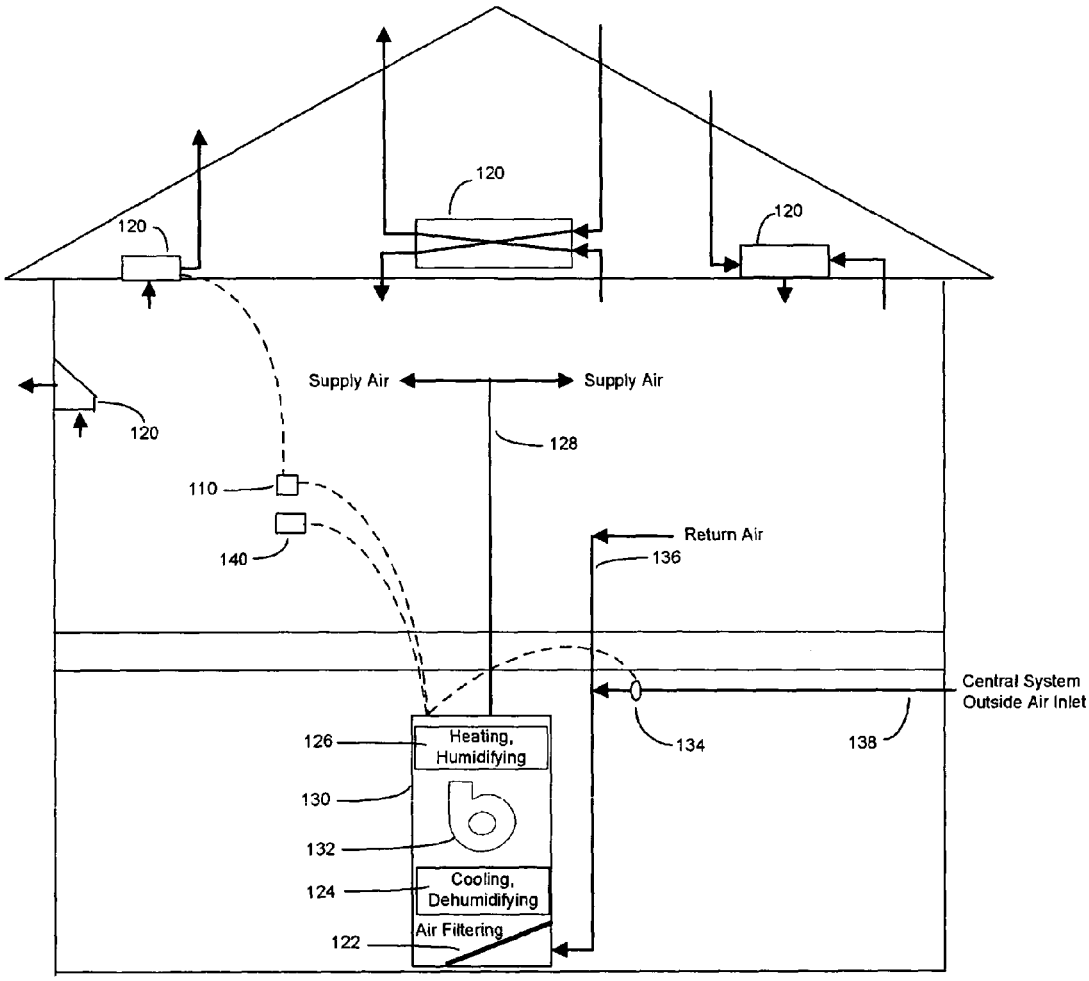
FIG. 4 shows a diagram of the ventilation and air distribution system in a house according to the present invention.

As previously described, there are three modes of ventilation fan operation, ON, OFF and AUTO. In a second embodiment shown in FIG. 3, the fan cycle controller 50 includes an auto mode selector 35 to allow the user to select an automatic mode of operation when the AUTO operational mode is selected. In this embodiment, the ventilation fan cycling is operated in conjunction with the operation of the central air conditioning system. FIG. 4 is a diagram according to the second embodiment wherein the fan cycle controller 110 communicates with the central air conditioning system controller 140. The central air conditioning system controller initiates demand for heating and/or humidifying 126, and cooling and/or dehumidifying 124, with coincident air circulation by blower 132. Common forms of a central air conditioning system controller include a thermostat and/or humidistat and/or dehumidistat. The central air conditioning system includes an air circulation fan 132, or blower, for distribution of conditioned air by multiple supply air ducts 128 and optionally includes a damper 134 and a duct 138 to the outside which is connected with the air return duct 136 to provide incoming air to the central air conditioning system 130. The incoming air passes through air filter 122 prior to being conditioned and distributed via air ducts 128. To avoid confusion with the ventilation fan, the central air distribution fan is referred to as a blower throughout the following description.

In the second preferred embodiment, there are three selectable automatic operation modes, Auto 1, Auto 2 and Auto 3. The Auto 3 mode in this second embodiment operates the same as the AUTO mode in the first embodiment. The Auto mode 1 and Auto mode 2 in this second embodiment differ operationally from the AUTO mode previously described for the first embodiment. In the second embodiment, the AUTO mode ventilation fan operation is based on operation of the central air conditioning system blower 132 when Auto 1 or Auto 2 is selected. In this embodiment, the fan cycle controller first checks the mode of operation. If the ventilation fan operational mode selector 30 is set to the ON mode, the ventilation fan 120 is activated, and when OFF mode is selected, the ventilation fan remains off unless manually activated as previously described for the first embodiment. When the AUTO operational mode is selected, the fan cycle controller determines which auto mode has been selected.

Figure 5:
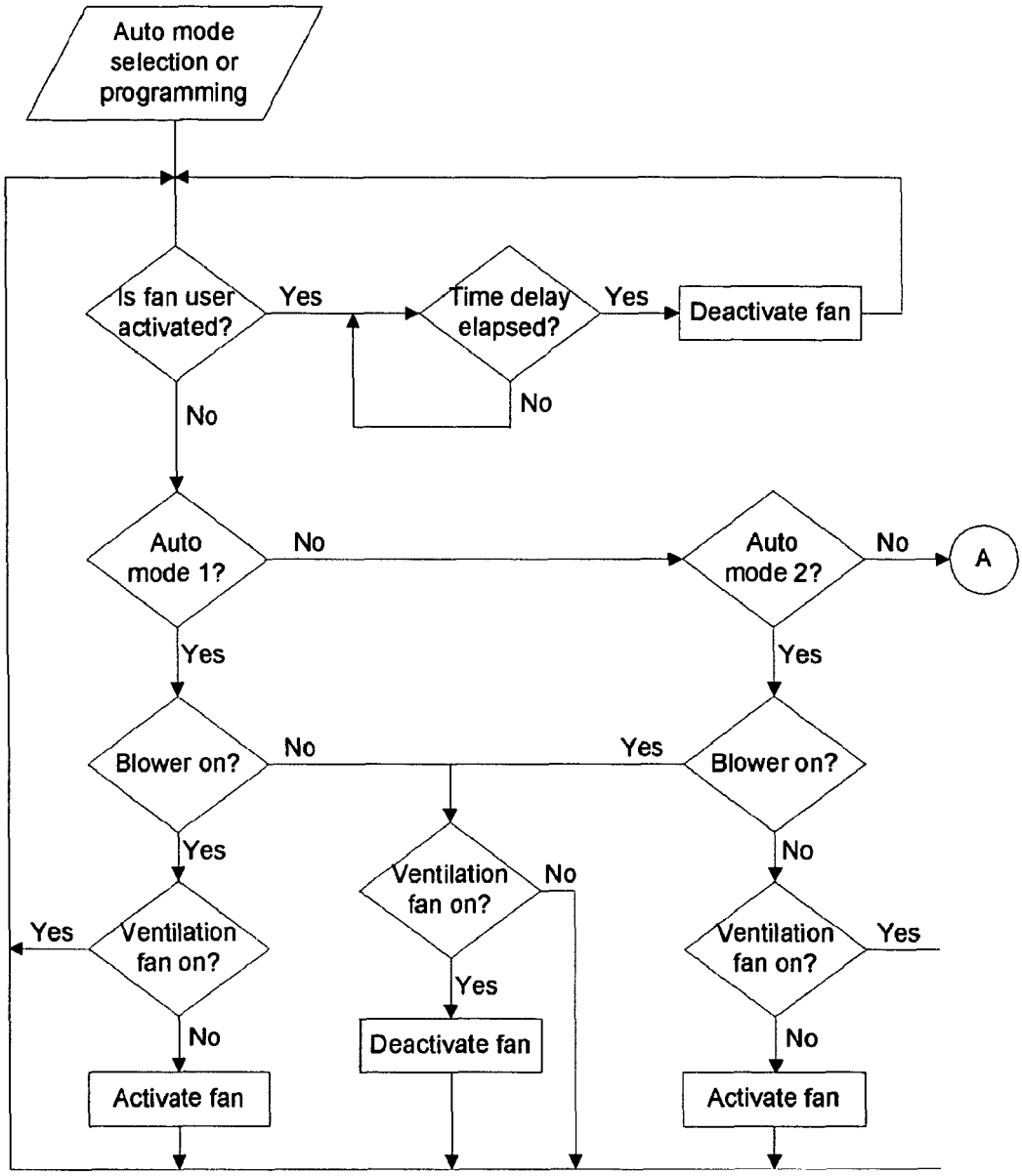
FIG. 5 is a flow diagram of the auto mode of the second embodiment of the present invention.

FIG. 5 is a flow diagram of operation in the auto mode according to the second embodiment. When Auto 1 is selected, the fan cycle controller checks the operational status of the blower and the ventilation fan 120 is activated whenever the blower 132 is on. If the blower turns off, the fan cycle controller 50/110 deactivates the ventilation fan 120. In Auto 2 mode, the fan cycle controller checks the operational status of the blower and the ventilation fan 120 is activated when the blower 132 is off. When Auto 3 is selected, the fan cycle controller automatically operates the ventilation fan 120 a selectable on-time per cycle interval based on prior operation of the ventilation fan due to both automatic and manual fan activation as described in the first embodiment and shown in the operational flow diagram of FIG. 2*b*.

Third Embodiment

Figure 6:
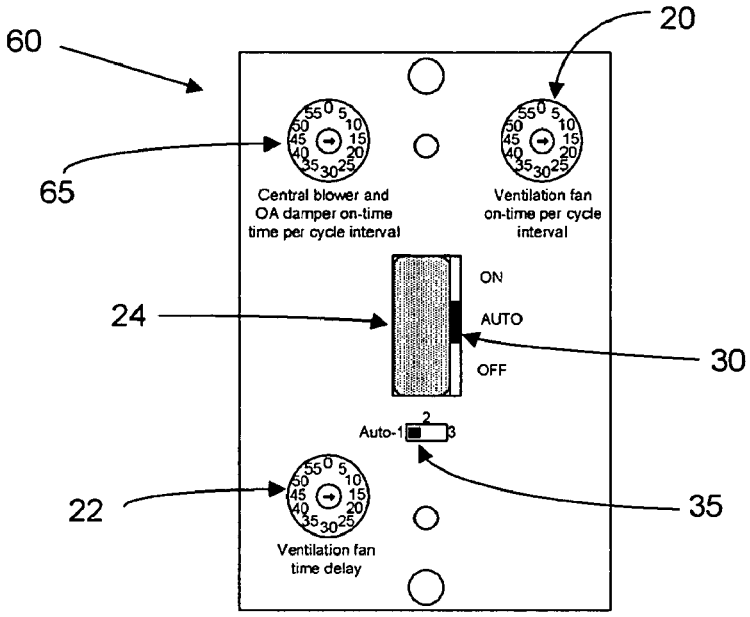
FIG. 6 is a front view of the fan cycle controller according to a third embodiment.

Referring to the fan cycle controller of FIG. 6 in conjunction with the air distribution system shown in FIG. 4, in a third embodiment of the invention, the fan cycle controller 60/110 provides selectable control of the blower 132 and the optional damper 134 and the ventilation fan 120 for ventilation and air mixing. In this embodiment the fan cycle controller 60 includes a blower interval selector 65. The blower interval selector 65 allows the user to select a minimum length of time the blower is operated per blower cycle interval, including operation due to central air conditioning system controller 140 (thermostat and/or dehumidistat and/or humidistat) demand and the fan cycle controller.

The central air conditioning system 130 may or may not include an outside air duct connected with the return air duct. When the system includes the outside air duct, when the blower was operating, outside air is drawn in and distributed by the central air conditioning system. Optionally, the outside air duct may include a motorized damper to limit the introduction of outside air. In this third embodiment, the blower and optional damper would not be activated by the cycle controller unless operational demand by the thermostat and/or humidistat or constant air selection failed to meet the minimal time per interval selected by the user. In an embodiment, the optional outside air damper is cycled off (closed) independent of the operation of the blower if the minimum ventilation time was achieved.

In the third embodiment, the blower on-time selector 65 is set to assure central air conditioning system blower activation, with optional motorized outside air damper activation, for the minimum blower on-time selected per blower cycle interval, including operation due to central air conditioning system controller demand. The cycle controller 60 would also automatically close the optional outside air damper, thus limiting the outside air damper open-time to the selected blower on-time per blower cycle interval, even if the blower continues to operate due to central air conditioning system controller demand. If the minimum blower on time is set to 'zero', automatic cycling of the blower, and optional damper, by the cycle controller is disabled.

Figure 7:
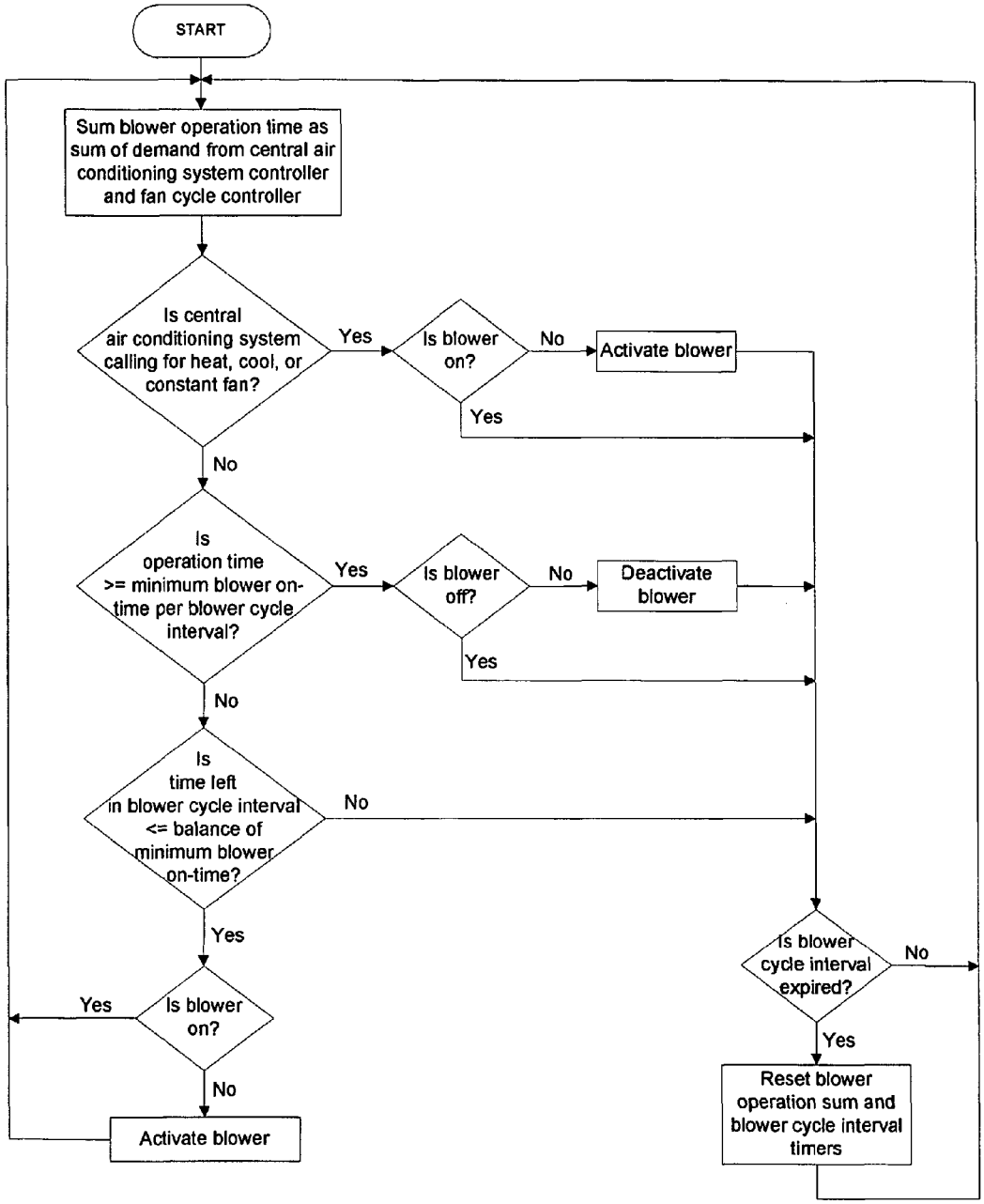
FIG. 7 is a flow diagram of the operation of the fan cycle controller according to the third embodiment.

Referring back to the system diagram of FIG. 4 in conjunction with the flow diagram of FIG. 7, the fan cycle controller 110 controls the operation of the ventilation fan and interfaces with the central air conditioning system controller 140 for monitoring the operation of heating, cooling, and constant fan, and cycling the blower 134, if needed, according to the blower on-time selector 65. If the blower on-time is set to 'zero' minutes, the fan cycle controller 60 does not activate the blower outside of demand from the central air conditioning system controller. Upon selection of a non-zero minimum blower on-time per blower cycle interval, the fan cycle controller monitors the sum of blower operation due to demand for heating, cooling, and constant fan from the central air conditioning system controller plus operation due to activation by the cycle controller.

The fan cycle controller monitors demand for heating, cooling, and blower operation from the central system controller and activates the blower in response to that demand. If there is no central system demand, and the blower on-time per blower cycle interval has been achieved, then the blower is deactivated. If the minimum blower on-time has not been met, and the time remaining in the blower cycle interval is less than or equal to the unmet minimum blower on-time, then the cycle controller will activate the blower. When the blower on-time or balance of blower on-time, expires, the blower is deactivated and the blower operation sum and blower cycle interval timers are reset for a next cycle interval. The cycle controller monitors whether the blower cycle interval time has expired, and if so, it resets timers monitoring the blower operation time sum and the remaining blower cycle interval time.

While the operation of the cycle controller has been described for operation according to the flow diagram of FIG. 7, the cycle controller simultaneously monitors and controls the operation of the ventilation fan according to the second embodiment as shown in the operational flow diagrams of FIGS. 2*b* and 5.

Fourth Embodiment

A fourth embodiment of the invention provides an apparatus, system and method for excluding automatic activation of the ventilation fan and/or the central system blower based on at least one of: a selectable time-of-day range; a selectable day-of-week range; outdoor air temperature range, and at least one of a heating, cooling, and dehumidification mode of the central air conditioning system. In this embodiment, the user optionally selects a time range and a central air conditioning system mode of operation and/or outdoor air temperature range during which the controller's automatic activation of the ventilation fan and/or the blower is deactivated. For example, a user may deactivate the automatic fan cycling operation at night when the central air conditioning system is in heat mode to prevent automatic activation of the ventilation fan and/or the blower from disturbing sleeping occupants and re-activate the automatic operation in the morning. Or for example, a user may deactivate the automatic fan cycling operation when the outdoor temperature is below 20° F. or above 100° F.

Figure 10:
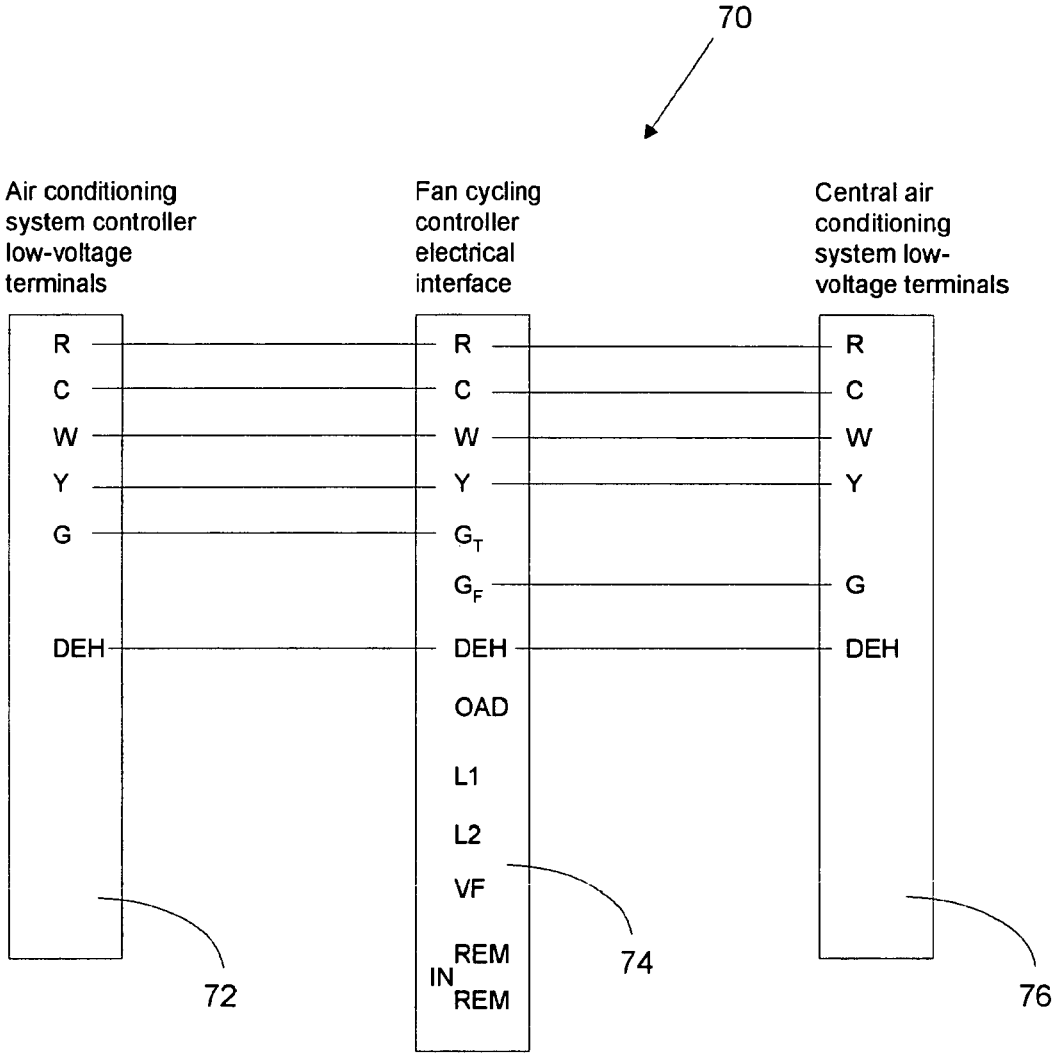
FIG. 10 is a wiring diagram of an electrical interface between the central air conditioning system controller and the fan cycling controller according to a fourth embodiment of the present invention.

The fan cycling controller monitors the central air conditioning system mode of operation via the electrical interface 70 shown in FIG. 10. Electrical interface includes electrical terminal block 72 for the central air conditioning system controller 140, terminal block 74 for the fan cycling controller 110, and terminal block 76 for the central air conditioning system 130. Common labeling conventions are shown for the three terminal blocks whereby, 'R' is 24 Vac, 'C' is 24 Vac common, 'W' is for heat control, 'Y' is for cooling control, 'G' is for fan control, '$G_T$' is for fan control from the central air conditioning system controller, '$G_F$' is for fan control from the fan cycling controller, 'DEH' is for dehumidification control from the central air conditioning system controller, 'OAD' is for outside air damper control from the fan cycling controller, 'L1' is for line voltage to the fan cycling controller, 'L2' is for line voltage neutral to the ventilation fan, 'VF' is for switched line voltage from the fan cycling controller to the ventilation fan, and 'REM IN' is for a low-voltage or line voltage signal input from a remote switch for activation of the ventilation fan on user demand.

The central air conditioning system mode of operation is determined by the fan cycle controller sensing and storing the last active system state including heating, cooling, constant fan, and dehumidification. In this embodiment, the controller may also provide a selectable day of the week to allow the user to select a first activation and deactivation time for weekdays and a second activation and deactivation time for weekends. Alternatively, the day-of-week selection may allow the user to select activation and deactivation times for each day of the week.

Figure 8:
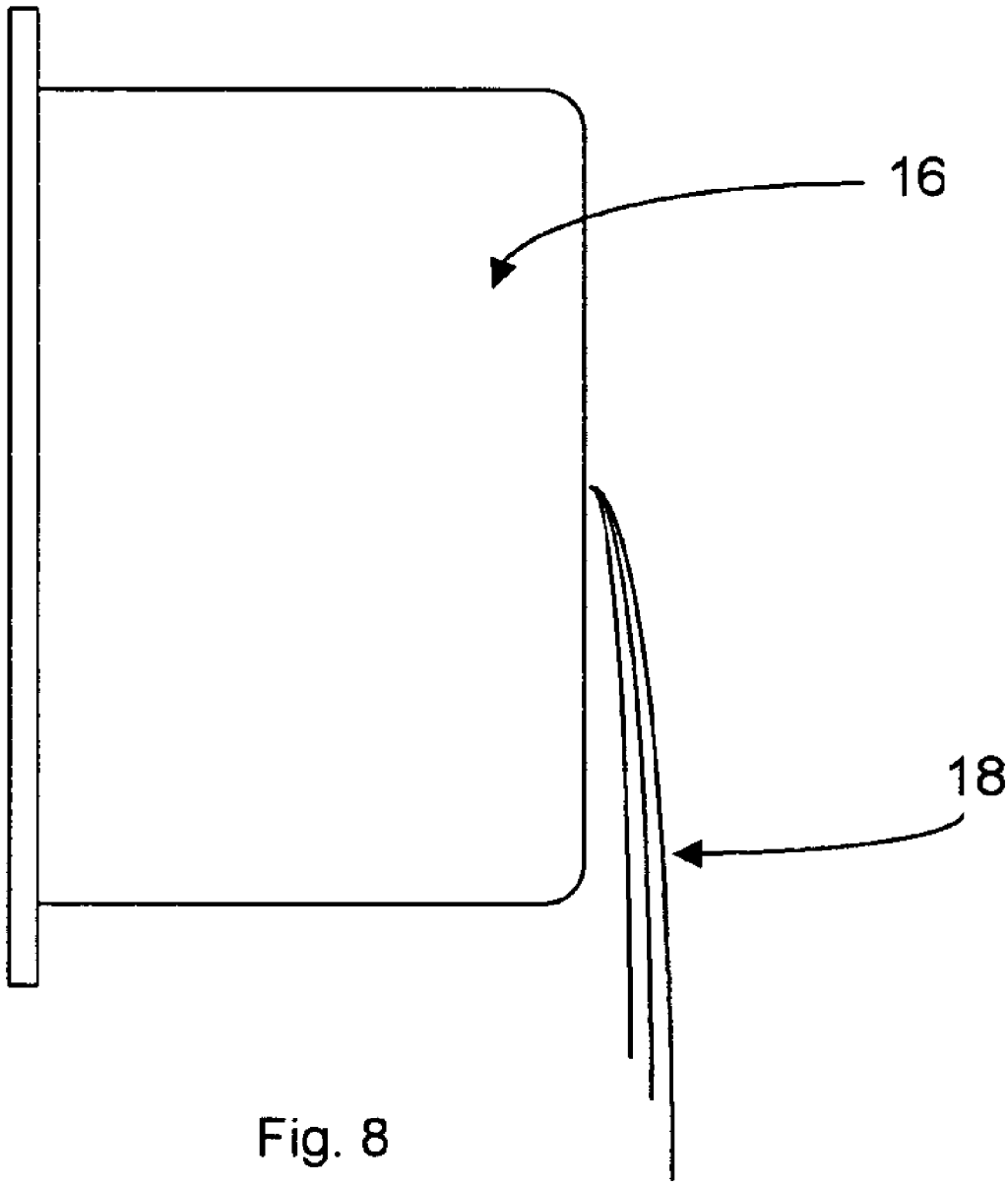
FIG. 8 is a side view of the fan cycle controller of the present invention.

In a preferred embodiment, the fan cycle controller fits in a standard electrical switch box enclosure 16 as shown in FIG. 8 and is installed in an interior area such as a bathroom or laundry, or other area. Use of existing fans with the fan cycle controller of the present invention is effective and less expensive than fans specially installed for additional ventilation, since the existing ventilation system, whether the fan exhausts indoor air from the house or pulls outdoor air into the house, already has ducts in place.

The enclosure 16 and electrical interface 18 provides a means for interfacing the fan cycle controller with the electrical system, the ventilation fan, the central air conditioning system, the central air conditioning system controller, and the optional motorized damper. In the first embodiment, line voltage is used to interface the fan cycle controller to the ventilation fan for operational control. In the second and third embodiments, low voltage wiring is used to interface the fan cycle controller to the low voltage control terminals of the central air conditioning system and central air conditioning system controller, and the optional motorized outside damper.

Figure 9:
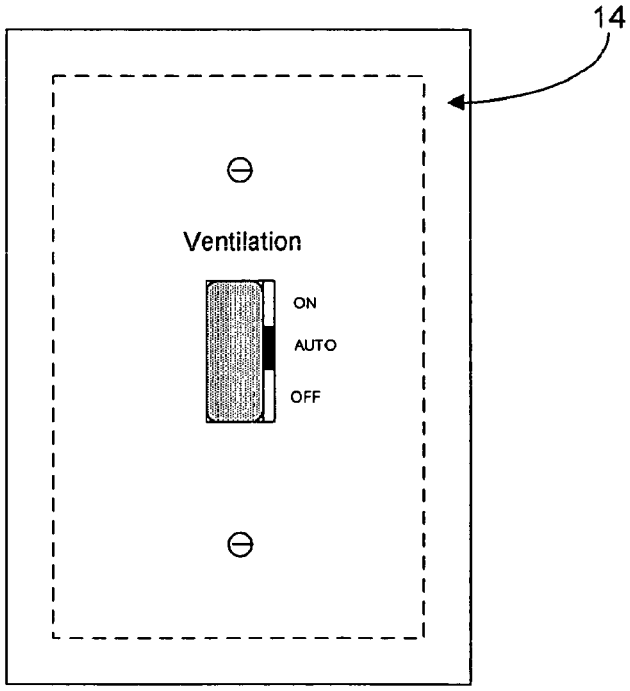
FIG. 9 is a front view of the fan cycle controller including a cover plate.

FIG. 9 shows an example of the cycle controller when a cover plate 14 is attached to the enclosure in a conventional manner. As shown, access to the interval selectors, delay selector and auto mode selector and other optional controls are covered by the cover plate 14. To gain access to the selectors to change the operation of the fan cycle controller, the cover plate is removed. Thus, the cover plate provides easy access by the user while preventing unauthorized or unintentional operation selection.

In summary, the present invention provides a new method, system, apparatus and device to provide an effective, automatic means to operate exhaust, supply, or balanced ventilation, or a combination thereof. The controller also provides manual activation for removal of pollution or supply of outdoor air, or a balance thereof, on demand. In an alternative embodiment, the ventilation fan is operated in conjunction with the central air conditioning system blower. Optionally, the cycle controller also automatically cycles the operation of the blower making sure that the blower is on for a minimum on-time per cycle interval, including operation due to central air conditioning system controller demand. Optionally, the outside damper would be cycled off (closed) independent of the central air distribution blower if the minimum ventilation time was accomplished.

Use of the novel fan cycle controller of the present invention is not limited in use for control of a single type of ventilation fan. The apparatus, method, system and device of the present invention are available for use with, but not limited to, exhaust fans, supply fans, heat recovery fans, energy recovery ventilation fans, mixing box ventilation fans, and to ventilating dehumidifier fans. Although the fan cycle controller has been described and shown with buttons and switches for user selection, alternative means, such as programmable control, may be substituted.

Those skilled in the art will recognize that random adjustment of the ventilation fan on-time per cycle interval or the central blower on-time per cycle interval or the cycle interval that do not materially alter the operation described herein is within the scope of the invention. Likewise, other immaterial time adjustments, such as but not limited to predicted future operation of the ventilation fan or the central blower, fall within the scope of the invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A system for distributing air in an interior space comprising:

a controller for controlling said distribution of said air within said interior space, said controller including a processor configured to execute instructions;

a ventilation fan connected to outside air and inside air, and interfaced with said controller;

a central air conditioning system interfaced with said controller and having an air circulating blower;

a manual activation switch for manually activating said ventilation fan on user demand;

a selectable operation mode of said ventilation fan, wherein said controller automatically operates said ventilation fan based on said selected operation mode and said manual activation; and wherein said instructions comprise a set of instructions for operating said ventilation fan in an auto mode of operation consisting of at least one of:

a first instruction activating said ventilation fan when said air circulating blower is on when a first auto mode is selected;

a second instruction for activating said ventilation fan when said air circulating blower is off when a second auto mode is selected; and a third instruction activating said ventilation fan for said a selected operation time per cycle interval based on prior said automatic and said manual operation of said ventilation fan when a third auto mode is selected.

2. The system of claim 1 wherein said selectable operation mode comprises:

a continuous operation mode, wherein said ventilation fan is continuously activated when said continuous operation mode is selected.

3. The system of claim 1 wherein said selectable operational mode comprises:

an off mode, wherein said ventilation fan remains off when said off mode is selected unless manually activated by said user demand.

4. The system of claim 1 further comprising:

a monitoring device for monitoring the operation of said central air conditioning system to determine an operational mode of said central air conditioning system based on a last operation of at least one of heating, cooling, constant fan, and dehumidification; and a selectable controller activation for selecting at least one of a time-of-day range, a day-of-week range, a central air conditioning system operational mode, and an outdoor air temperature range, wherein said automatic operation of said ventilation fan is disabled based on said at least one of said time-of-day range, said day-of-week range, said central air conditioning system operational mode, and said outdoor air temperature range.

5. The system of claim 1, further comprising:

a selectable operation mode of said air circulating blower, wherein said controller automatically activates said air circulating blower fora first time per second time based on prior operation of said circulating blower.

6. The system of claim 5 further comprising:

a monitoring device for monitoring the operation of said central air conditioning system to determine an operational mode of said central air conditioning system based on a last operation of at least one of heating, cooling, constant fan, and dehumidification; and a selectable controller activation for selecting at least one of a time-of-day range, a day-of-week range, a central air conditioning system operational mode, and an outdoor air temperature range, wherein said automatic operation of said air circulating blower is disabled based on said at least one of said time-of-day range, said day-of-week range, said central air conditioning system operational mode, and said outdoor air temperature range.

7. The system of claim 5 further comprising:

an outside air duct connected to an air return duct of said central air conditioning system, and said outside air duct having a damper, wherein said damper is automatically activated by said controller in conjunction with activation of said air circulating blower and automatic deactivation of said damper to limit said damper open-time to said first time per said second time even if said air circulating blower continues to operate.

8. The system of claim 1 further comprising:

a selectable time delay, wherein said controller activates said ventilation fan for said selected time delay in response to manual activation on said user demand.

* * * * *